US005859379A

United States Patent [19]

Ichikawa

[11] Patent Number: 5,859,379

[45] Date of Patent: Jan. 12, 1999

[54] METHOD OF AND APPARATUS FOR COMPOSING A MELODY BY SWITCHING MUSICAL PHRASES, AND PROGRAM STORAGE MEDIUM READABLE BY THE APPARATUS FOR COMPOSING A MELODY

[75] Inventor: Mamoru Ichikawa, Koganei, Japan

[73] Assignee: Kabushiki Kaisha Works Zebra, Tokyo, Japan

[21] Appl. No.: 896,032

[22] Filed: Jul. 17, 1997

[30] Foreign Application Priority Data

Jul. 18, 1996 [JP] Japan ..... 8-189269

[51] Int. Cl.[6] ..... G10H 1/26; G10H 1/40

[52] U.S. Cl. ..... 84/609; 84/611; 84/649; 84/651; 84/478

[58] Field of Search ..... 84/609–614, 634–638, 84/477 R, 478, 649–652, 666–669

[56] References Cited

U.S. PATENT DOCUMENTS 5,200,566 4/1993 Shimaya ..... 84/609
5,281,754 1/1994 Farrett et al. ..... 84/609
5,347,082 9/1994 Ojima ..... 84/609
5,386,081 1/1995 Nakada et al. ..... 84/609
5,696,343 12/1997 Nakada ..... 84/609

*Primary Examiner*—Stanley J. Witkowski
*Attorney, Agent, or Firm*—Kane, Dalsimer, Sullivan, Kurucz, Levy, Eisele and Richard, LLP

[57] ABSTRACT

An apparatus for composing a melody by switching musical phrases sequentially corresponding to key input signals, and playing the switched musical phrases smoothly. The apparatus selects musical phrase data, which consists of note data and phrase change information data from a memory corresponding to the key input signals, then reads selected phrase data and plays a musical phrase corresponding to the phrase data. If a key input signal is detected during the playing of a musical phrase, the apparatus selects phrase data corresponding to the signal at the timing that the latest phrase change information data is read after the detection. The note data has a predetermined scale note value and read timing. The phrase change information data has a predetermined read timing. The scale note value and the read timing are predetermined so that a melody becomes in rhythm and in tune when musical phrases are sequentially played according to the note data that are included in selected phrase data.

7 Claims, 6 Drawing Sheets

METHOD OF AND APPARATUS FOR COMPOSING A MELODY BY SWITCHING MUSICAL PHRASES, AND PROGRAM STORAGE MEDIUM READABLE BY THE APPARATUS FOR COMPOSING A MELODY

BACKGROUND OF THE INVENTION

1. Field of the Invention

The present invention relates to an apparatus and a method, which composes a melody and an accompaniment by switching musical phrase data, each of which is an element of a melody data which indicates the melody and the accompaniment, and a program storage medium readable by the apparatus for combining a melody and an accompaniment.

2. Description of the Related Art

It is well known that an electronic musical instrument which plays predetermined melodies or accompaniment patterns, which are read out from a memory device, by pressing each key or some combination of keys of a keyboard, instead of generating a musical note in correspondence with the key.

Japanese Patent Laid Open Hei No.8-6549 discloses a method of composing a melody on the basis of the information of the position of a figure which is displayed on a display of a computer.

In these apparatus and method, a new melody is selected and played rapidly when each key is pressed, or when the beginning of the next musical time unit such as a measure, etc. comes after the key is pressed.

The former has the defect that a rhythm of a previous melody dose not harmonize with a rhythm of the new melody, so that a whole melody is not played smoothly.

The latter has the defect that the other key pressing while the melody is played is not reflected in the melody.

SUMMARY OF THE INVENTION

It is therefore an object of the present invention to provide an apparatus for and a method of combining a melody, in which a change of an input signal from the external can be reflected, and which can maintain the continuity of a whole melody.

The above object of the present invention can be achieved by an apparatus for composing a melody by switching musical phrase data, each of which is an element of melody data which indicates the melody, in correspondence with an input signal inputted from an external, the apparatus provided with: an input device through which the input signal indicating an arbitrary value can be inputted; a first memory for storing a plurality of musical phrase data including at least phrase change information data to change the musical phrase data at such a timing as to maintain a continuity of a composed melody; a first selection device for selecting musical phrase data from the first memory in correspondence with the value of the input signal inputted through the input device; a play device for playing the melody on the basis of the selected musical phrase data; a second memory for storing the value of the input signal if the input signal is inputted through the input device while the play device is playing the composed melody; a detection device for detecting the phrase change information data in the musical phrase data, on the basis of which the musical phrase is to be nextly played by the play device; a judgment device for judging whether or not the input signal is inputted through said input device while the play device is playing the phrase data if the phrase change information data is detected by the detection device; a second selection device for selecting a new musical phrase data from the first memory in correspondence with the value of the input signal stored in the second memory, if the input signal is inputted according to a judgment by the judgment means; and a switch device for switching the musical phrase data, on the basis of which the musical phrase is currently played, to the new musical phrase data after the phrase change information data is detected by the detection device.

Accordingly, when the input signal is inputted through the input device, one of musical phrase data in correspondence with the input signal is selected from among a plurality of musical phrase data stored in the first memory by the first selection device. Then, a melody is played on the basis of the selected musical phrase data by the play device. Nextly, when a new input signal is inputted through the input device while the melody is played by the play device, the new input signal is stored in the second memory. Then, in case that the phrase change information data is detected in the musical phrase data by the detection device, it is judged whether or not the new input signal is stored in the second memory while the phrase data is played by the judgment device. If the new input signal is stored in the second memory, the second selection device selects new musical phrase data on the basis of the stored input signal. Further, the switching device switches the musical phrase data, on the basis of which the melody is played before the detection, to the new musical phrase data.

Consequently, in case that the input signal is inputted through the input device while the phrase data is played, new musical phrase data is switched at the timing of the phrase change information data is detected. The phrase change information data has the timing which maintains a continuity of the composed melody, so that the melody is played continuously.

As one aspect of the apparatus of the present invention, the input device is provided with at least one of a musical keyboard, a keyboard of a computer, a virtual keyboard on a display of the computer, a virtual musical keyboard on the display of the computer, a pendulum, or a virtual pendulum on the display of the computer. Thus the input signal can be continuously inputted through one of these devices, so that the phrases are continuously switched and smoothly corresponds to the input signal.

As another aspect of the apparatus, the input device is provided with the input device for inputting a graphical data of at least one of a still image and a moving image. Thus the input signal is continuously inputted in correspondence with the graphic data, so that the phrases are continuously combined and smoothly corresponds to the input signal.

As another aspect of the apparatus of the present invention, the first memory stores a plurality of the musical phrase data with respect to each value of the input signal, and each of the first selection device and the second selection device selects one of the musical phrase data from the first memory. Thus in case that the input signal which has the same value is repeatedly inputted, the other musical phrase data which is different from the former one is selected by the second selection device. Further the switch device switches the selected musical phrase data, on the basis of which the melody is played, to the new musical phrase data. Therefore, it is possible to play a wide variety of the composed melody.

As another aspect of the apparatus of the present invention, the second selection device selects any one of the musical phrase data from the first memory if the value of the input signal which is newly inputted through the input device while the play device is playing the composed melody, is coincident with the value of the input signal, on the basis of which the musical phrase is currently played, and selects one predetermined musical phrase data from the first memory if the value of the newly inputted signal is not coincident with the value of the input signal. Thus in case that the input signal which has the same value is repeatedly inputted, the other musical phrase data which is different from the former one is selected by the second selection device. Further the switch device switches the selected musical phrase data, on the basis of which the melody is played, to the new musical phrase data. On the other hand, if the value of the new input signal is not coincident with the value of the last input signal, on the basis of which the melody is played, one predetermined musical phrase data is selected by the second selection device, and the switch device switches the selected musical phrase data, on the basis of which the melody is played, to the predetermined new musical phrase data. Therefore, the phrases are switched in correspondence with the changing of the input signal which is inputted through the input device, and it is possible to play a wide variety of the composed melody for the variation of the input signal.

The above object of the present invention can be achieved by a method of composing a melody and an accompaniment by switching musical phrase data, each of which is an element of melody data which indicates the melody and the accompaniment, in correspondence with an input signal inputted from an external, the method provided: an input step of inputting the input signal indicating an arbitrary value through an input device; a first selection step of selecting musical phrase data from among a plurality of musical phrase data including at least a phrase change information data to change the musical phrase data at such a timing as to maintain a continuity of a composed melody, in correspondence with the value of the input signal inputted through the input device; a play step of playing the melody on the basis of the selected musical phrase data; a store step of storing the value of the input signal if the input signal is inputted through the input device while the composed melody is played; a detection step of detecting the phrase change information data in the musical information data, on the basis of which the selected musical phrase is to be nextly played; a judgment step of judging whether or not the input signal is inputted through the input device while the phrase data is played if the phrase change information data is detected; a second selection step of selecting new musical phrase data from among a plurality of musical phrase data in correspondence with the value of the stored input signal, if the input signal is inputted according to the judgment; and a switch step of switching the musical phrase data, on the basis of which the musical phrase is currently played, to the new musical phrase data after the phrase change information data is detected.

Accordingly, when the input signal is inputted through the input device, one of musical phrase data in correspondence with the input signal is selected from among a plurality of the musical phrase data. Then, the melody is played on the basis of the selected musical phrase data. Nextly, when a new input signal is inputted through the input device while the melody is played, the new input signal is stored. Then, in case that the phrase change information data is detected in the musical phrase data, it is judged whether or not the new input signal is stored while phrase data is played. If the new input signal is stored, new musical phrase data is selected on the basis of the stored input signal. Further, the selected musical phrase data, on the basis of which the melody is played before the detection, is switched to the new musical phrase data.

Consequently, in case that the input signal is inputted through the input device while the phrase data is played, new musical phrase data is switched at the timing of the phrase change information data is detected. The phrase change information data has the timing which maintains a continuity of the composed melody, so that the melody is played continuously.

The above object of the present invention can be achieved by a program storage medium readable by an apparatus for composing a melody, tangibly embodying a program of instructions executable by the apparatus to perform method steps for composing a melody by switching musical phrase data, each of which is an element of melody data which indicates the melody, in correspondence with an input signal inputted from an external, the method steps provided: an input step of inputting the input signal indicating an arbitrary value through an input device; a first selection step of selecting a musical phrase data from among a plurality of musical phrase data including at least phrase change information data to change the musical phrase data at such a timing as to maintain a continuity of a composed melody, in correspondence with the value of the input signal inputted through said input device; a play step of playing the melody on the basis of the selected musical phrase data; a store step of storing the value of the input signal if the input signal is inputted through the input device while the composed melody is played; a detection step of detecting the phrase change information data in the musical information data, on the basis of which the selected musical phrase is to be nextly played; a judgment step of judging whether or not the input signal is inputted through the input device while the phrase data is played if the phrase change information data is detected; a second selection step of selecting new musical phrase data from among a plurality of musical phrase data in correspondence with the value of the stored input signal, if the input signal is inputted according to the judgment; and a switch step of switching the musical phrase data, on the basis of which the musical phrase is currently played, to the new musical phrase data after the phrase change information data is detected.

Accordingly, when the input signal is inputted through the input device, one musical phrase data in correspondence with the input signal is selected from among a plurality of the musical phrase data. Then, the melody is played on the basis of the selected musical phrase data. Nextly, when a new input signal is inputted through the input device while the phrase data is played, the new input signal is stored. Then, in case that the phrase change information data is detected in the musical phrase data, it is judged whether or not the new input signal is stored while melody is played. If the new input signal is stored, new musical phrase data is selected on the basis of the stored input signal. Further, the selected musical phrase data, on the basis of which the melody is played before the detection, is switched to the new musical phrase data.

Consequently, in case that the input signal is inputted through the input device while the phrase data is played, new musical phrase data is switched at the timing of the phrase change information data is detected. The phrase change information data has the timing which maintains a continuity of the composed melody, so that the melody is played continuously.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, an embodiment of the present invention will be now explained.

First Embodiment

Figure 1:
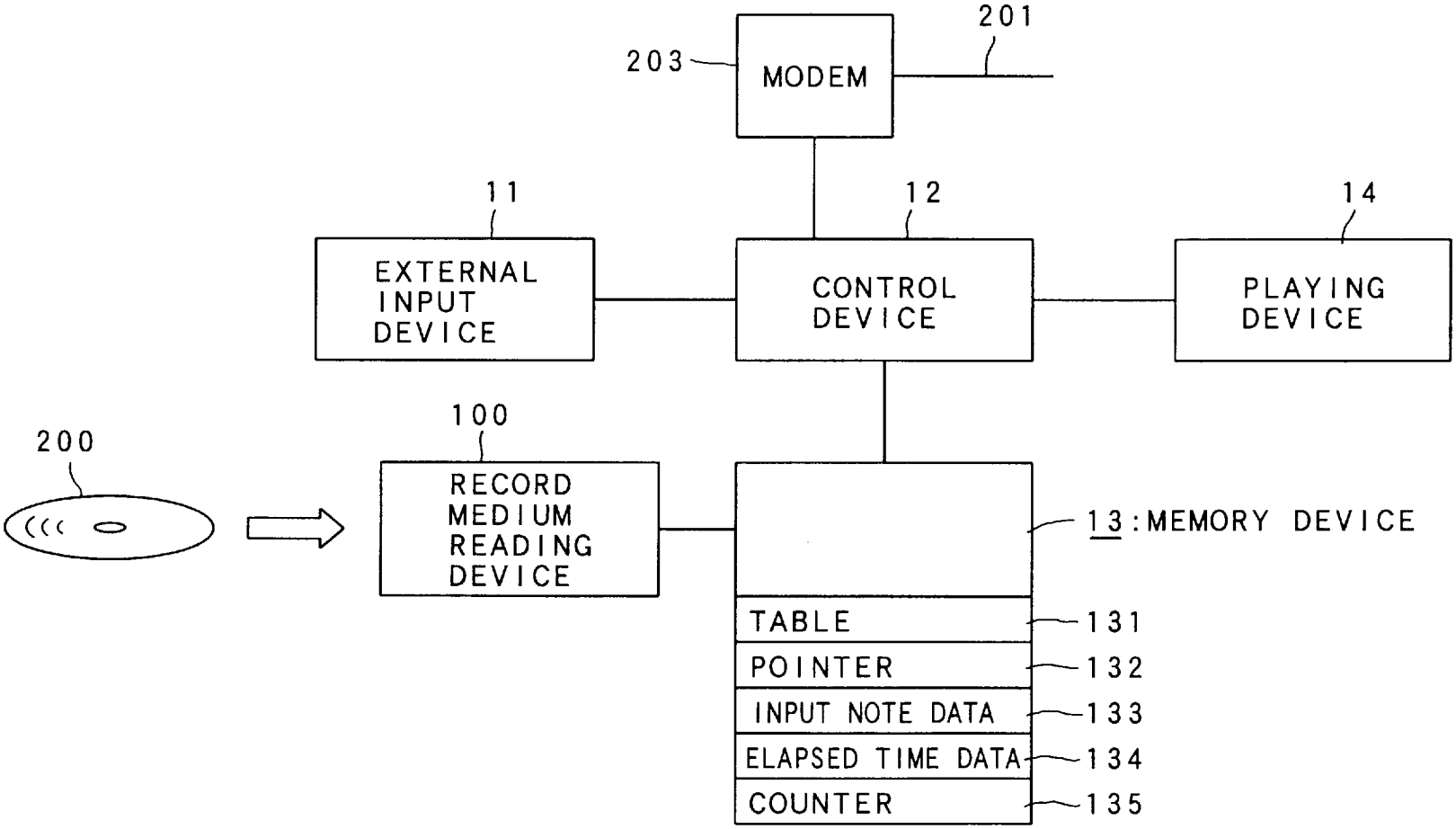
FIG. 1 is an outline constitution block diagram of an apparatus for composing a melody as an embodiment of the present invention.

FIG. 1 is an outline constitution of an apparatus for composing a melody according to a first embodiment. The apparatus of the embodiment of the present invention has devices as follows.

An external input device 11 is an input device such as a musical keyboard. When any key of the external input device 11 is pressed by a user, data, which indicates the height of the note, the strength of the note, etc., such as a MIDI signal, is sent to a control device 12. The control device 12 which is provided with a CPU etc., controls a data input operation, a data selecting operation for play, etc. Therefore, the data which is inputted through the external input device 11, is stored in a memory device 13 as input note data 133, under the control of the control device 12. On the other hand, melody data corresponded to input note data 133, is stored in the memory device 13 as data filled in table 131 which describes a relationship between input note data and phrase data. The phrase data is selected according to the input note data 133 with reference to table 131 by the control device 12.

The control device 12 has a record medium reading device 100 such as an optical disk driver device, a floppy or flexible disk driver device and so on, and a record medium 200 readable by the record medium reading the device 100, such as an optical disk, a floppy or flexible disk and so on . The record medium 200 as one example of a program storage device, tangibly embodies a program of instructions executable by the control device 12 to perform method steps of combining a melody as explained in detail later with reference to flow chart of FIGS. 3 and 7. The program read by the re cord medium reading device 100 may be stored in the memory device 13, so as to speedily execute the program. Alternatively, the program may be received through the communication line 201 by a modem 203, and stored into the memory device 13.

Figure 2:
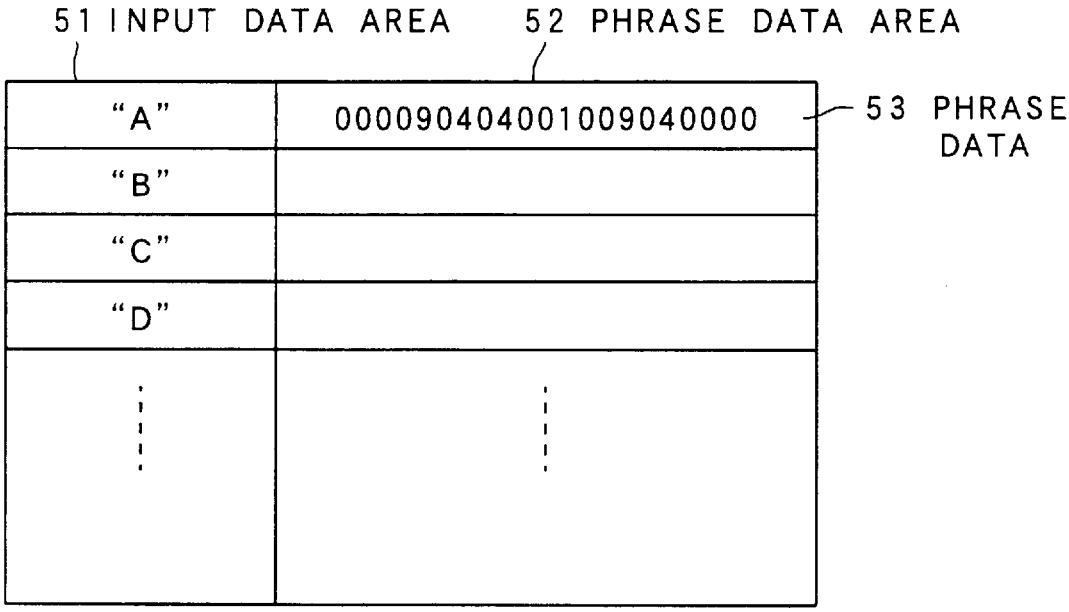
FIG. 2 is a table for describing the relationship between input data and melody data of a first embodiment of the present invention.

Next, the construction of the data to be used in the operation of the present embodiment will be explained. The table 131 is shown in FIG. 2. A plurality of values of input data each of which is inputted through the external input device 11, are recorded at an input data area 51 as shown in left side of the table 131. Phrase data 53 which corresponds to the values of the input data, are recorded at a phrase data area 52 as shown in right side of the table 131. Therefore, the phrase data 53 to be selected for play, is determined uniquely according to the value at the input data area 51 in correspondence with the input data which is inputted through the external input device 11.

Figure 3:
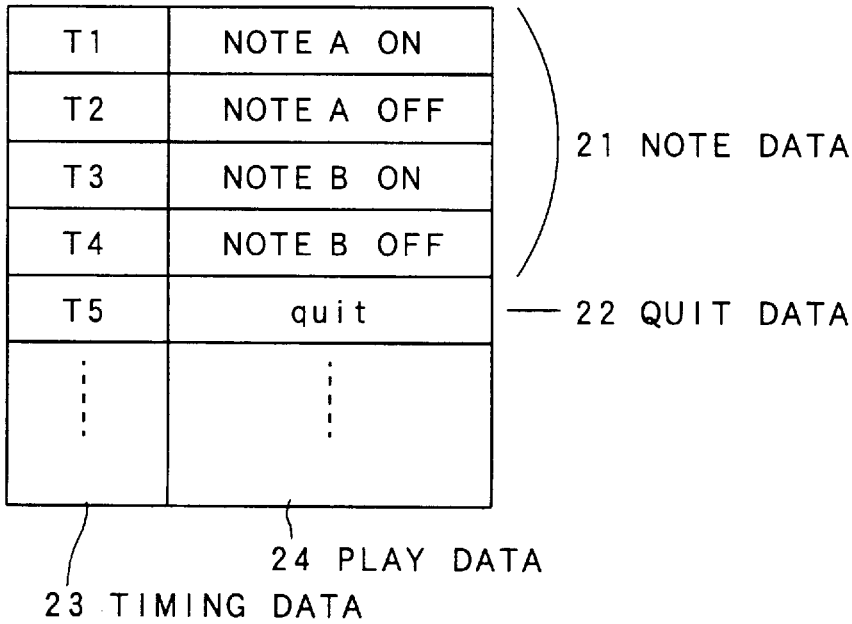
FIG. 3 is a diagrammatic representation for describing the constitution of phrase data of a first embodiment of the present invention.

As shown by FIG. 3, the phrase data 53 includes a timing data 23 which shows the time to play, and play data 24 on the basis of which a play device 14 plays the phrase. The phrase data on the basis of which the play device 14 plays the phrase, is managed by a control device 12 by using a pointer 132.

The timing data 23 shows a timing to generate a sound of a note, and indicates the elapsed time from the beginning of the phrase. As shown in FIG. 3, the timing data 23 has time values T1, T2, T3, T4, and T5. At the time value T1, a note A is turned on, and at the time value T2, the note A is turned off, and at the time value T3, a note B is turned on, and at the time value T4, the note B is turned off. The play data 24 has not only normal note data but also QUIT data 22 which indicates the timing which a phrase can be switched to a new phrase while the phrase is played. The QUIT data 22 is used only for switching the phrases, not for generating a sound of any note. A counter 135 in the memory device 13 indicates a pair of the timing data 23 and play data 24 on the basis of which the phrase is played.

By the above mentioned constitution, the play data 24 in the melody data, which is in correspondence with the input data through the external input device 11, is read out sequentially from the table 131 by the control device 12. Then, the play data 24 is sent to the play device 14, so that a melody is generated. An elapsed time from the beginning of a phrase is stored as an elapsed time data 134 in the memory device 13.

Next, the operation of the present embodiment will be explained. The operation explained hereinbelow is performed by the control unit 12 in according with the program to instruct to perform the method of composing a melody, which is recorded on the record medium 200 and is read by the record medium reading device 100. The read program may be stored in the memory device 13.

Figure 4:
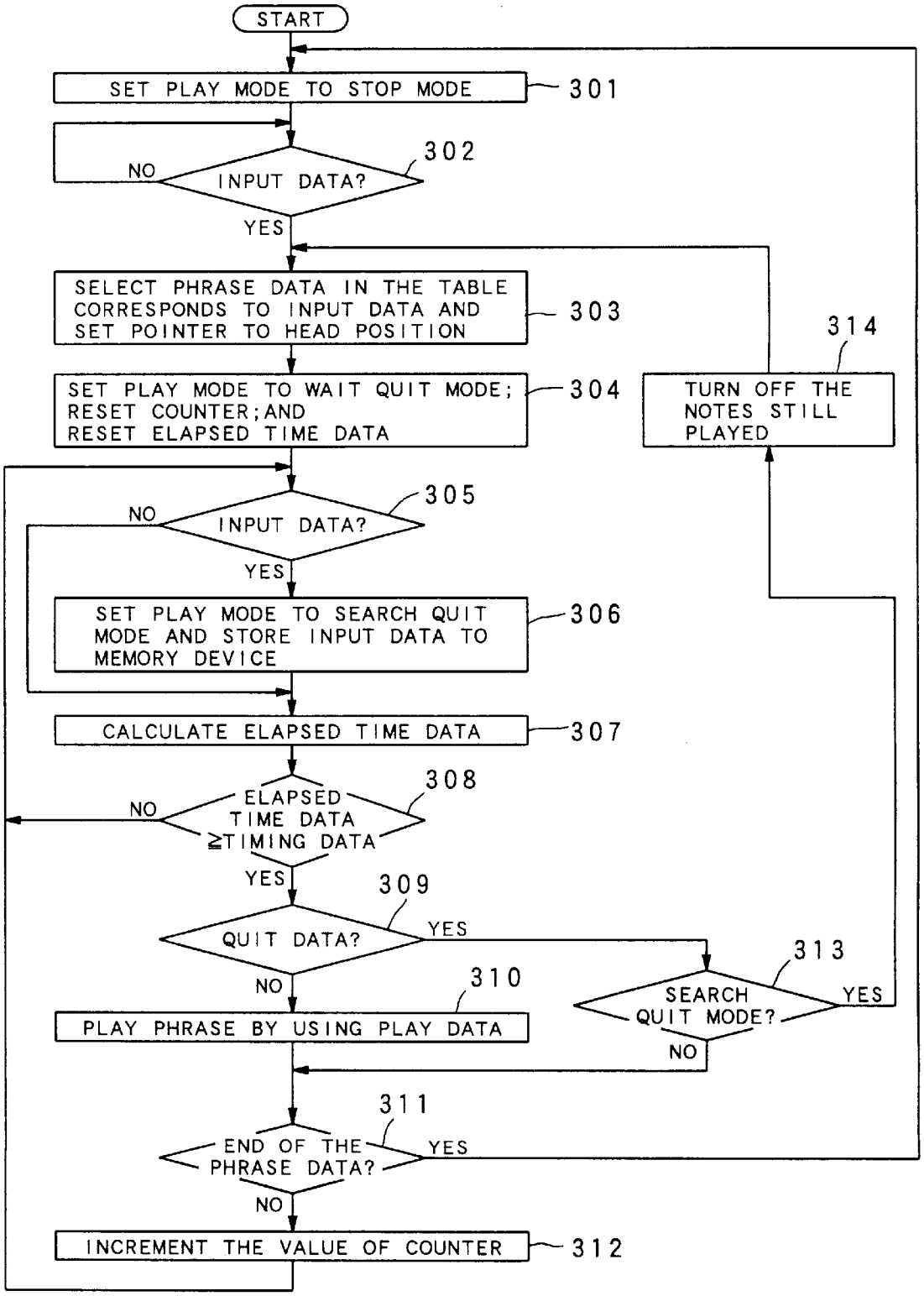
FIG. 4 is a flow chart of a method of composing a melody of a first embodiment of the present invention.

The method of composing a melody by executing the above mentioned program is explained with reference to a flow chart in FIG. 4. First of all, a state of control is shown by a play mode. Initially, the play mode is set to a stop mode(step 301). This mode means that a phrase is not played yet, and it is available to start to play whenever the input data is inputted by the external input device 11. Then, it is judged whether or not the input data is inputted through the external device 11(step 302). If the input data is not inputted, it is judged again(step 302;NO). When the input data is inputted (step 302;YES), the phrase data 53 corresponding to the input data is read out from the table 133, and a head position of phrase data 53, such as an address on the memory device 13, is set to the pointer 132(step 303).

After that, the play mode is set to a wait quit mode, and all of the values of the elapsed time data 134 and the counter 135, which indicates the state of playing, are reset to prepare for starting to play the phrase(step 304). In the wait quit mode, the present phrase cannot be switched to a new melody until the QUIT data 22 appears in the phrase data 53, if a new data is inputted while the melody is played.

Next, before the phrase is played, it is judged whether or not the input data is inputted through the external input device 11 by control device 12(step 305). When the input data is inputted(step 305;YES), the play mode is changed to a search quit mode which means a next phrase data to be played exists, and the inputted key information is stored in the memory device 13 as the input note data 133(step 306). Then, the elapsed time data 134 is calculated(step 307). It is judged whether or not the total value of the elapsed time data 134 is not below the value of the timing data 23(step 308). In case that the value of the elapsed time data 134 is below the value of the timing data 23(step 308;NO), the detection of the input data, which is inputted through the external input device 11, is executed by the control unit again(step 305).

On the other hand, when the total value of the elapsed time data 134 is not below the value of the timing data 23(step 308;YES), it is judged whether or not the play data 24 is coincident with the QUIT data 22, which indicates the timing to allow to switch to a new phrase, (step 309). When the play data 24 is not coincident with the QUIT data 22(step 309;NO), the play data 24 is sent to the play device 14, and the play device 14 plays the melody which consists of the play data 24(step 310).

After that, it is judged whether or not the phrase data 53 is finished(step 311). In case that it is not finished(step 311;NO), the value of the counter 135 is incremented(step 312), and it is judged again whether or not any data is inputted by the external input device 11(step 305,306), after that, the next play data 24 in the present phrase data 53 is played continuously. When all melody data 53 are already played(step 311;YES), the process returns to the beginning of the process for waiting the next input data which is inputted through the external input device 11(step 301).

On the other hand, in case that the play data 24 at the playing timing is coincident with the QUIT data 22 which means the timing to allow to change to a new phrase(step 309;YES), it is judged whether or not the play mode is the search quit mode(step 313). In case that the play mode is the search quit mode(step 313;YES), other phrase data 53 is selected(step 303). The search quit mode means that the present phrase data 53 should be changed to new melody data which corresponds to the new input data. Therefore, if there is any note of the phrase still being played, playing the phrase is finished (step 314), and new phrase data is selected by control device 12 so that the new phrase is played (step 303–313).

If the playing of the new phrase is started, the play mode is set to the wait quit mode. The new phrase is played on the basis of the new phrase data 53 which corresponds to the input note data 133(step 304).

On the other hand, if the play mode is not the search quit mode (step 313;NO), this means that the next data is not inputted yet by the external input device 11. It is judged whether or not all phrase data are already played (step 311). If it is not finished(step 311;NO), the value of the counter 135 is incremented(step 312). It is judged whether or not any data is inputted by the external input device 11 again(step 305,306). After that, the next play data 24 in the present phrase data 53 is played continuously. If all melody data 53 are already played(step 311;YES), the process returns to the beginning of the process again for waiting the new input data by the external input device 11(step 301).

Figure 5:
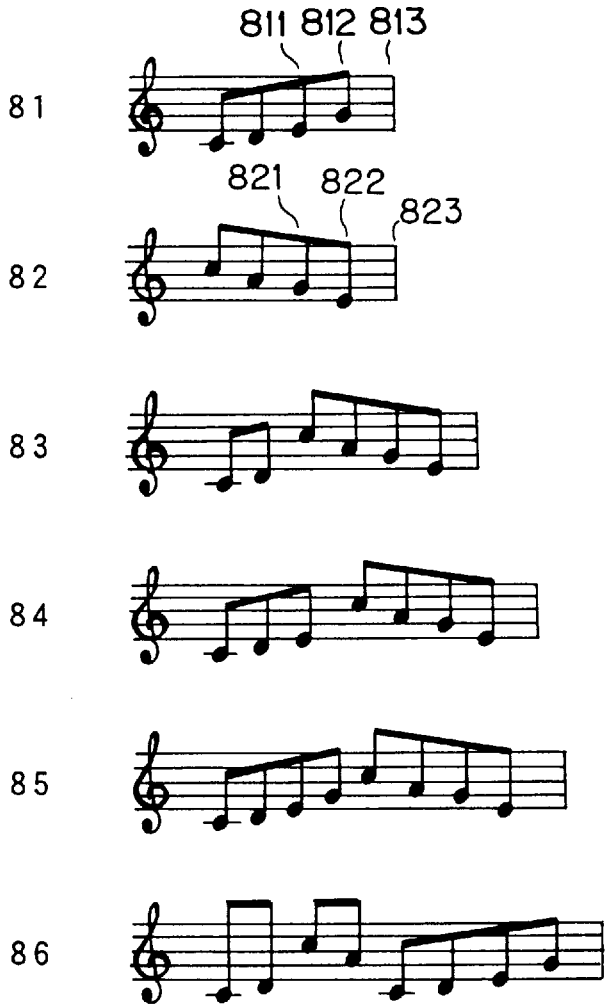
FIG. 5 is a musical score of a phrase and a composed melody of a first embodiment of the present invention.

Next, an example of phrase data 53 and a composed melody will be explained referring to FIG. 5. In FIG. 5 three QUIT data 22 are included in the phrase data 81,82. And one of the QUIT data 22 is positioned at the timing 811 which is the timing just precede the third eighth note in the phrase data 81, and another QUIT data 22 is positioned at the timing 812 which is the timing immediately before the forth eighth note in the phrase data 82, and the last QUIT data 22 is positioned at the timing 813 which is the timing just precede the next note (actually, the next note data dose not exist in the phrase). Similarly, the QUIT data 22 is positioned at the timing 821,822,823 in the phrase data 82 as shown in FIG. 5.

In case that the above mentioned phrase data is stored, when the phrase data 81 is selected by the first input, playing of a phrase is started by using the phrase data 81. When the phrase data 82 is selected by the new input data while melody is played by using the phrase data 81, the phrase data 81 and the phrase data 82 are connected at the timing of appearing of the QUIT data 22 in the phrase data 81. It is possible that three kinds of melodies can be composed according to the input timing in the phrase data 81 of the new input data while melody is played.

Namely, when the input data is inputted at the timing before the timing 811, i.e. while the two eighth notes arranged in the first half of the phrase data 81 are played, the melody is changed to new another melody on the timing 811 of appearing of the QUIT data 22 which is the timing immediately before the third eighth note in the phrase data 81. As a result, a composed melody 83 is continuously played. Similarly, when the input data is inputted at the timing between the timing 811 and the timing 812 which is equal to the timing between the third of eighth note and the forth of eighth note, a composed melody 84 is played. When the input data is inputted at the timing between the timing 812 and the timing 813 that is equal to the timing between the forth of eighth note and the fifth of eighth note, a composed melody 85 is played.

Each of composed melody 83,84,85 is created by combining two phrase data 81,82. It is possible that nine different kinds of melodies are generated, for example, a composed melody 86 in the case that the phrase data 81 is selected according to further input data which is inputted while melody is played by using the phrase data 82. As mentioned above, when the input data is inputted continuously while melody is played, the melody is extended, and the variations of the composed melody are increased according to the timing of the input data.

As mentioned above, according to the present embodiment, in case that the melody is played by switching the phrase data, the phrase is switched only at the timing which is predetermined in the phrase data. Therefore, in spite of any pattern of the input data by the user, the melody can be played keeping the rhythm and line of the music. The stored input note data 133 is always changed to the newest one so that the composed melody can respond immediately to input data by the user.

It is possible that the constitution of the above embodiment is changed. For example, in above embodiment, the phrase data is selected in table, but it is also appropriate that the phrase data is selected among a phrase database by some algorithm.

It is also possible to use a device which is provided with a plurality of pendulums as the external device 11 except for the musical keyboard. In this case, the input data for the period or the amplitude of each of pendulum is substitution for the input note data 133. Therefore, it is possible that the input data is inputted periodically by moving the pendulum, and the input operation is stopped by stopping the motion of the pendulum.

It is also possible that the pointing device of the graphical data is used as the external input device 11. In this case, by pointing an arbitrary position in the graphical data, the graphical data in the position such as brightness, hue, etc., that is a RGB(Red-Green-Blue) value of pixel etc., is extracted. The extracted data will be the input data which is substitution of the input note data 133. Therefore, the music is played on the basis of the composed melody by pointing the arbitrary position of the graphical data.

When the difference between new graphical data of the pixel which is pointed continuously by dragging and last graphical data of the pixel is more than a constant threshold value, it is realized that a new pointing is occurred so that a next phrase is selected and played. In this case, the melody is smoothly composed, and it is not necessary for the user to care for adjusting rhythm precisely.

In the above mentioned example, the pointing is done by using the pointing device, but it is possible that the pointing is done automatically by some algorithm stored in the memory device. Further, it is possible to play a variety of melodies automatically by changing a static image continuously or by using a moving image.

Further, in the above mentioned example, only the newest input data in a plurality of input data is stored in the input data 133, but it is possible that a plurality of the input note data are stored in the input data 133. In this case, all of the input data by the user responds faithfully to the constitution of the melody.

In the setting of the play mode, a flexible setting is available. In above embodiment, new phrase data 53 is always started at the timing of appearing the QUIT data 22, but it is possible that the phrase currently played is stopped at the timing of inputting the input data, and a new phrase data 53 is started in correspondence with the changing of the play mode by the user while the melody is played. It is also possible the play mode is set to the mode in which the input data is ignored. It is possible that the timing of playing a new phrase is delayed until the beginning of the next musical time unit such as a measure. In this manner, it is possible to play the melody variously on the basis of the input data by the external input device 11 and the selected play mode.

In above embodiment, the melody is finished when the last play data of the phrase data is played, but it is possible that the melody is interrupted and stopped when all keys of the keyboard are released by the user. It is also possible that the melody is interrupted and stopped when it is judged that the play data is coincident with the QUIT data 22(step 309) under the condition that the user releases all keys of the keyboard. Accordingly, it is possible to stop playing on the basis of the key release action.

The phrase data may include not only the musical melody itself such as the phrase data 81 but also a single note such as only one whole note. For example, eight pieces of the QUIT data 22 which has the timing on which the whole note is divided to eighth notes, are added to the phrase data, which has the only one whole note. Only scale note to fit to harmony which is currently played is available to correspond to the input data in the table. As a result, it is possible to compose the melody by only available note scale consisting of eighth note in minimum, so as not to play any avoid note which is disharmonious against the chord.

Second Embodiment

Next, a second embodiment will be explained referring to FIG. 6 and FIG. 7. However, the explanations of the same constructional elements as those of the melody compose apparatus shown in FIG. 1 and FIG. 2 and a process of composing are omitted.

Figure 6:
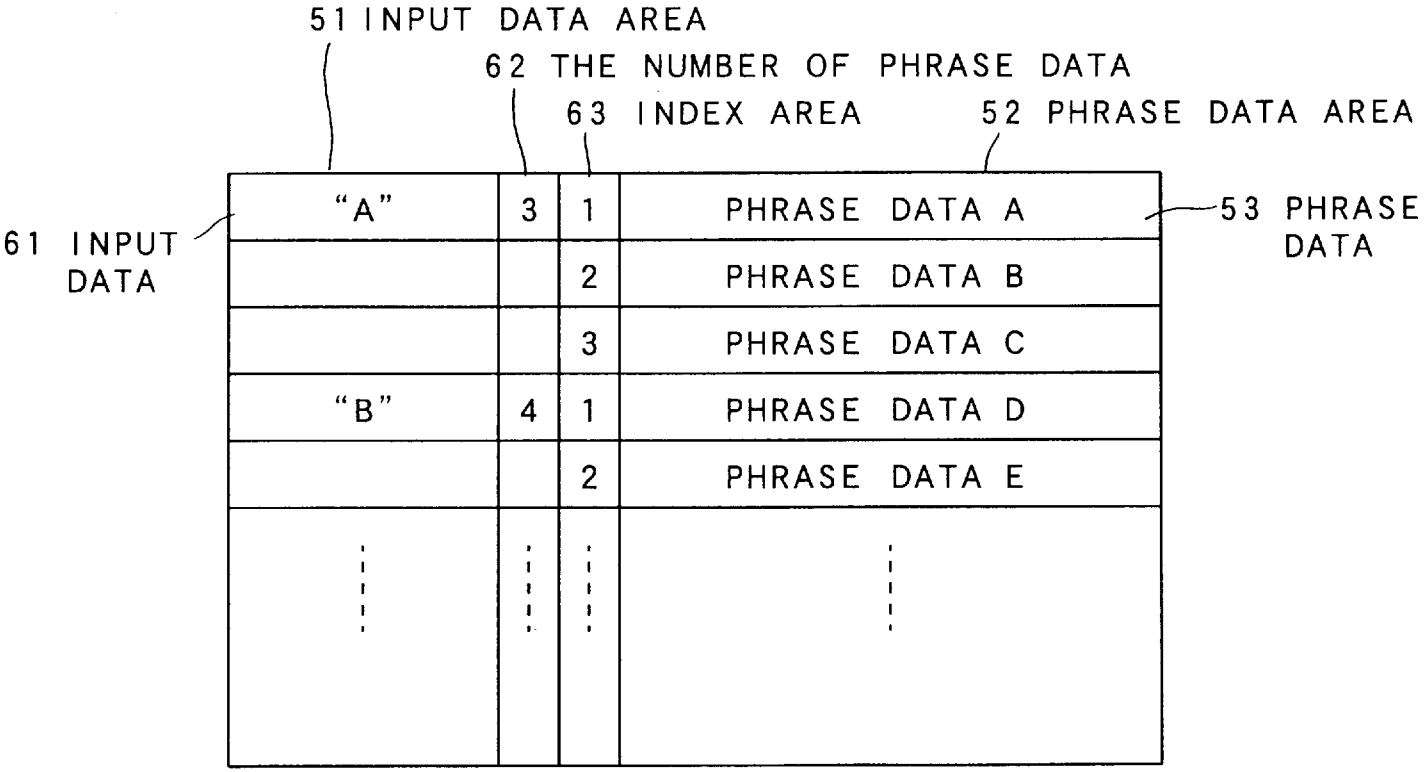
FIG. 6 is a table for describing the relationship between input data and melody data of a second embodiment of the present invention.

In the present embodiment, a table shown in FIG. 6 is used as an alternative to the table shown in FIG. 2 used in first embodiment. In the aforementioned first embodiment, the melody data 53 is determined uniquely with respect to the input note data 51. However, in the second embodiment, one phrase data is selected from a plurality of phrase data the number of which is shown by the number of phrase area 62 corresponding to one input note data 61. For example, one phrase data is selected from among the phrase data A–C corresponding to the input data "A" in FIG. 6.

Figure 7:
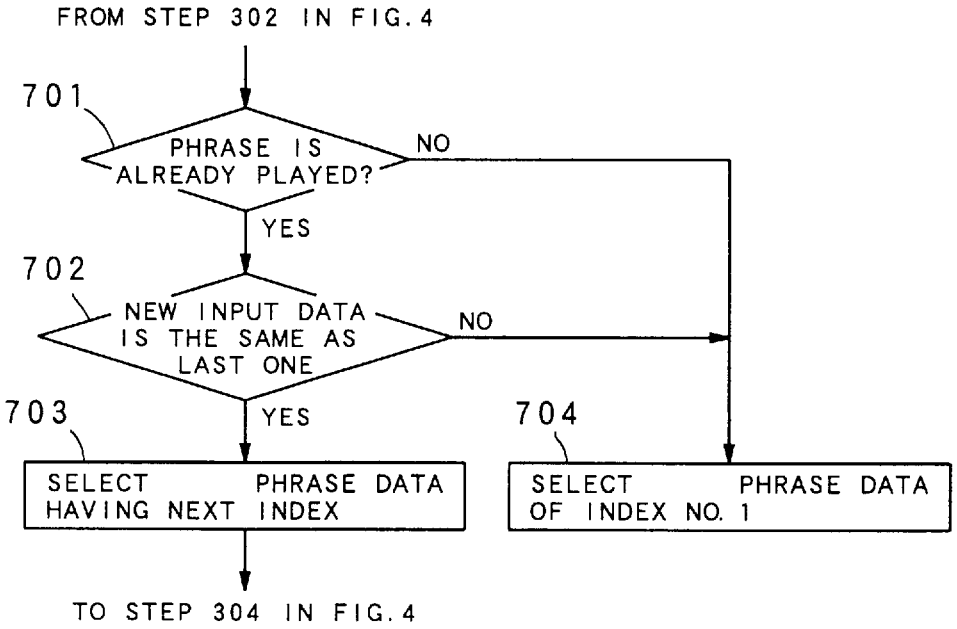
FIG. 7 is flow chart of a method of combining a melody of a second embodiment of the present invention.

A method of selecting the phrase data in the second embodiment is shown in a flow chart of FIG. 7. In this case, the process shown in step 303 of the flow chart in FIG. 4 is replaced by the process shown in a flow chart in FIG. 7. When the input data is inputted through the external input device 11, it is judged whether or not the phrase is already played at the time. In case that the phrase is played(step 701;YES), it is judged that a new input note data 133 corresponds to the input data 61 which is pointed by the pointer 132 and corresponds to the phrase currently being played(step 702). When it is equal to the input data 61 (step 702;YES), the value of the pointer 132 is set to the phrase data the index of which is the next index in the index area 63 in the phrase data currently being played and pointed by the pointer 132. The pointed data becomes the new phrase data(step 703).

On the other hand, if the phrase is not played yet when the input data is inputted (step 701;NO), or although the phrase is already played, the input data is not equal to the last one (step 702;NO), index NO.1 phrase data is always selected (step 704).

According to the present embodiment, a different phrase is played corresponding to the same input note number 133 in case that the input data is inputted continuously by the same key pressing while the phrase is played. When the input data is inputted continuously by pressing the different key, the phrase data 53 is selected regularly, so that regularity of the composed melody is maintained.

It is possible to change the constitution of the present embodiment. For example, in the table 2 of FIG. 6, the melody data is selected from among a plurality of the melody data 53 at random, or in the order of ascending, in a predetermined order or the like. It is also possible to prepare a plurality of tables in FIG. 6 and perform parallel control for each table. In this case, the plurality of phrases are selected from each table, in correspondence with one input note 133, are controlled and played at the same time. For example, it is possible that the music is played by using each different composed melody with a plurality of the musical instruments such as guitar, drums, etc. An apparatus for and a method of composing a melody of the present invention is applied to an electrical music instrument provided with a keyboard, a sound source and a controller, also applied to a personal computer loaded software, and also applied to an information recording medium such as a CD-ROM etc. on which the program to execute the above mentioned process of composing melody is recorded.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An apparatus for composing a melody by switching musical phrases sequentially corresponding to key input signals, and playing the switched musical phrases smoothly, said apparatus comprising:

a key input means having a plurality of keys, for generating key input signals to designate playing musical phrases;

a memory for storing a plurality of musical phrase data including at least a phrase change information data to change the musical phrase data, and at least a note data indicating a note of which a musical phrase consists;

a selection means for selecting a musical phrase data from the memory corresponding to the key input signal; and a play means for reading the musical phrase data selected by the selection means, and playing the musical phrase corresponding to the musical phrase data;

wherein said selection means selects said musical phrase data corresponding to said key input signal at the timing which the latest phrase change information data is read after detecting said key input signal during playing said musical phrase;

wherein each of said musical phrase data stored in the memory consists of said note data having a predetermined scale note value and read timing, and said phrase change information data having a predetermined read timing; and wherein said scale note value and read timing are predetermined so that said melody is smoothly generated in tune and in rhythm when musical phrases are sequentially played according to said note data which are included in said musical phrase data being selected by said selection means.

2. The apparatus according to claim 1, wherein said key input means is provided with at least one of a musical keyboard, a keyboard of a computer, a virtual keyboard on a display of the computer, a virtual musical keyboard on the display of the computer, a pendulum, and a virtual pendulum on the display of the computer.

3. The apparatus according to claim 1, wherein said key input means is provided with an input device for inputting a graphical data of at least one of a still image and a moving image.

4. The apparatus according to claim 1, wherein said memory stores a plurality of the musical phrase data with respect to each value of the key input signal, and said selection means selects one musical phrase data from said memory.

5. The apparatus according to claim 1, wherein said selection means selects any one of the musical phrase data from said memory if the value of the of the key input signal which is newly inputted through said key input means while said play means is playing the musical phrase, is coincident with the value the key input signal, on the basis of which the musical phrase is currently played, and selects one predetermined musical phrase data from said memory if the value of the newly inputted signal is not coincident with the value of the key input signal.

6. A method of composing a melody by switching musical phrases sequentially corresponding to key input signals, and playing the switched musical phrases smoothly, said method comprising the steps of:

a key input step of inputting the key input signals generated by a key input means;

a selection step of selecting a musical phrase data corresponding to the key input signal from among a plurality of musical phrase data including at least a phrase change information data to change the musical phrase data, and at least a note data including a note of which a musical phrase consists; and a play step of reading the musical phrase data selected by the selection step, and playing the musical phrase corresponding to the musical phrase data;

wherein in said selection step, said musical phrase data is selected in correspondence with said key input signal at the timing which the latest phrase change information data is read after said key input signal being detected during said musical phrase being played;

wherein in said selection step, each of said musical phrase data consists of said note data having a predetermined scale note value and read timing, and said phrase change information data having a predetermined read timing; and wherein said scale note value and read timing are predetermined so that said melody is smoothly generated in tune and in rhythm when musical phrases are sequentially played according to said note data which are included in said musical phrase data being selected in said selection step.

7. A program storage medium readable by an apparatus for composing a melody, tangibly embodying a program of instructions executable by the apparatus to perform method steps for composing a melody by switching musical phrases sequentially corresponding to key input signals, and playing the switched musical phrases smoothly, said method comprising the steps of:

a key input step of inputting the key input signals generated by a key input means;

a selection step of selecting a musical phrase data corresponding to the key input signal from among a plurality of musical phrase data including at least a phrase change information data to change the musical phrase data, and at least a note data including a note of which a musical phrase consists; and a play step of reading the musical phrase data selected by the selection step, and playing the musical phrase corresponding to the musical phrase data;

wherein in said selection step, said musical phrase data is selected in correspondence with said key input signal at the timing which the latest phrase change information data is read after said key input signal being detected during said musical phrase being played;

wherein in said selection step, each of said musical phrase data consists of said note data having a predetermined scale note value and read timing, and said phrase change information data having a predetermined read timing; and wherein said scale note value and read timing are predetermined so that said melody is smoothly generated in tune and in rhythm when musical phrases are sequentially played according to said note data which are included in said musical phrase data being selected in said selection step.

* * * * *